US006679323B2

(12) United States Patent
Vargervik et al.

(10) Patent No.: US 6,679,323 B2
(45) Date of Patent: Jan. 20, 2004

(54) SEVERE DOG LEG SWIVEL FOR TUBING CONVEYED PERFORATING

(75) Inventors: Kristian Vargervik, Stavanger (NO); Colby W. Ross, Houston, TX (US); Tim W. Sampson, Spring, TX (US)

(73) Assignee: Baker Hughes, Inc., Houston, TX (US)

( * ) Notice: Subject to any disclaimer, the term of this patent is extended or adjusted under 35 U.S.C. 154(b) by 78 days.

(21) Appl. No.: 10/021,798

(22) Filed: Nov. 30, 2001

(65) Prior Publication Data

US 2003/0102122 A1 Jun. 5, 2003

(51) Int. Cl.[7] ..... E21B 43/118; E21B 17/05
(52) U.S. Cl. ..... 166/55.1; 166/66.7; 166/242.3
(58) Field of Search ..... 166/55, 55.1, 65.1, 166/66.7, 242.2, 242.3, 242.6

(56) References Cited

U.S. PATENT DOCUMENTS 4,410,051 A 10/1983 Daniel et al.
4,438,810 A 3/1984 Wilkinson
4,637,478 A * 1/1987 George ..... 175/4.51
4,830,120 A * 5/1989 Stout ..... 175/4.51
4,842,059 A * 6/1989 Tomek ..... 166/65.1
5,040,619 A 8/1991 Jordan et al.
5,078,650 A * 1/1992 Foote ..... 464/104
5,211,714 A 5/1993 Jordan et al.
5,259,466 A * 11/1993 Venditto et al. ..... 175/4.51
5,415,238 A * 5/1995 Nice ..... 166/381
5,421,780 A * 6/1995 Vukovic ..... 464/102
5,603,379 A 2/1997 Henke et al.
5,769,558 A * 6/1998 Jekielek ..... 403/229
5,964,294 A 10/1999 Edwards et al.
6,484,801 B2 * 11/2002 Brewer et al. ..... 166/65.1

* cited by examiner

*Primary Examiner*—Frank Tsay
(74) *Attorney, Agent, or Firm*—Darryl M. Springs; Keith R. Derrington

(57) ABSTRACT

One embodiment of the present invention discloses a system for use with a downhole tool while perforating deviated portions of subterranean wellbores. The system involves a swivel connection attaching subsequent segments of the downhole tool which increases the overall flexibility of the downhole tool. The swivel connection allows sections of the downhole tool to pivot with respect to the next adjacent section.

20 Claims, 3 Drawing Sheets

SEVERE DOG LEG SWIVEL FOR TUBING CONVEYED PERFORATING

BACKGROUND OF THE INVENTION

1. Field of the Invention

The invention relates generally to the field of oil and gas well services. More specifically the present invention relates to a system that provides flexibility between adjacent segments of a downhole tool to enhance use of the downhole tool in deviated or slanted wells.

2. Description of Related Art

When perforating guns, are used in slanted or deviated wellbores it is often important that the tool be in a specific radial orientation. For example, orienting perforating guns in deviated wells enables the well operator to aim the shaped charges of the perforating gun at specific radial locations along the circumference of the wellbore. This is desired because the potential oil and gas producing zones of each specific well could exist at any radial position or region along the wellbore circumference. Based on the presence and location of these potential producing zones adjacent a deviated well, a well operator can discern a perforating gun orientation whose resulting perforations result in a maximum hydrocarbon production. Not only could a perforation aimed at the wrong angle not result in a preferred hydrocarbon production, but instead could produce unwanted sand production from the surrounding formation into the wellbore.

Numerous attempts have been made to overcome the problem of orienting downhole tools. These attempts include eccentrically weighting downhole tools to rotate in a certain manner or by adding external fins to the tool body to force the tool into a predefined position. Some of these can be found in U.S. Pat. Nos. 4,410,051, 4,438,810, 5,040,619, 5,211,714, 4,637,478, 5,603,379, and 5,964,294.

Many downhole tools, including perforating guns, comprise multiple elongated bodies joined end to end. If the elongated bodies are to be rotated or axially positioned, the elongated bodies must be able to rotate freely with respect to the adjacent body or bodies they are connected to. When a long downhole tool is inserted within a deviated wellbore, forces of compression and tension result along the downhole tool because of the linear deformation of the tool caused by the curved wellbore. Free rotation of the elongated bodies of a downhole tool is hindered if the tool is under compression or tension. If free rotation of the elongated bodies is hindered, they will not be able to be positioned into the desired orientation. Therefore, when the downhole tool consists of multiple perforating guns, and compressive or tensile loading binds the guns, perforations cannot be produced at the desired spots along the wellbore.

Therefore, there exists a need for a device or system in connection with downhole tools containing orienting features, where the improvement provides flexibility and prevents binding of the tool when it encounters deviated or slanted wellbores.

BRIEF SUMMARY OF THE INVENTION

One embodiment of the present invention discloses a system for use in a well comprising at least two downhole tools in combination with at least one swiveling sub. The swiveling sub connects the tools end to end. The swiveling subs incorporate two sections pivotally connected to each other on one of their ends, one possible form of connection involves a ball and socket configuration. Downhole tools, such as perforating guns, are connected to both ends of the swiveling sub.

Also included in the system is a wear ring positioned radially around each downhole tool. The wear ring outer diameter is greater than the outer diameter of said downhole tool and prevents the outer diameter of the downhole tool from contacting the inner wall of the wellbore. Because the downhole tool is not in contact with the inner wall of the wellbore, the downhole tool will not experience the type and magnitude of wear as seen by downhole tools that are allowed to rub along the wellbore inner wall. Further, preventing contact between the tool and the wellbore promotes free rotation of the downhole tool because the resistance to rotation due to the wellbore inner wall is removed. Bearings are included within the invention to promote rotation of the downhole tool with respect to the swiveling subs.

The present invention further includes a detonation cord axially disposed within each section. Each section also includes a shaped charge in cooperation with an explosive device that passes explosive detonation from its detonation cord to the detonation cord disposed in an adjacent section.

One of the many features of the present invention involves increasing the flexibility of a downhole tool string to facilitate ease of insertion and retraction of the downhole tool from a wellbore. Making the downhole tool string more flexible also decreases internal compressive and tensile stresses along the string which enables individual components of the tool string to rotate about their axis with respect to the remainder of the tool string.

DETAILED DESCRIPTION OF THE INVENTION

Figure 1:
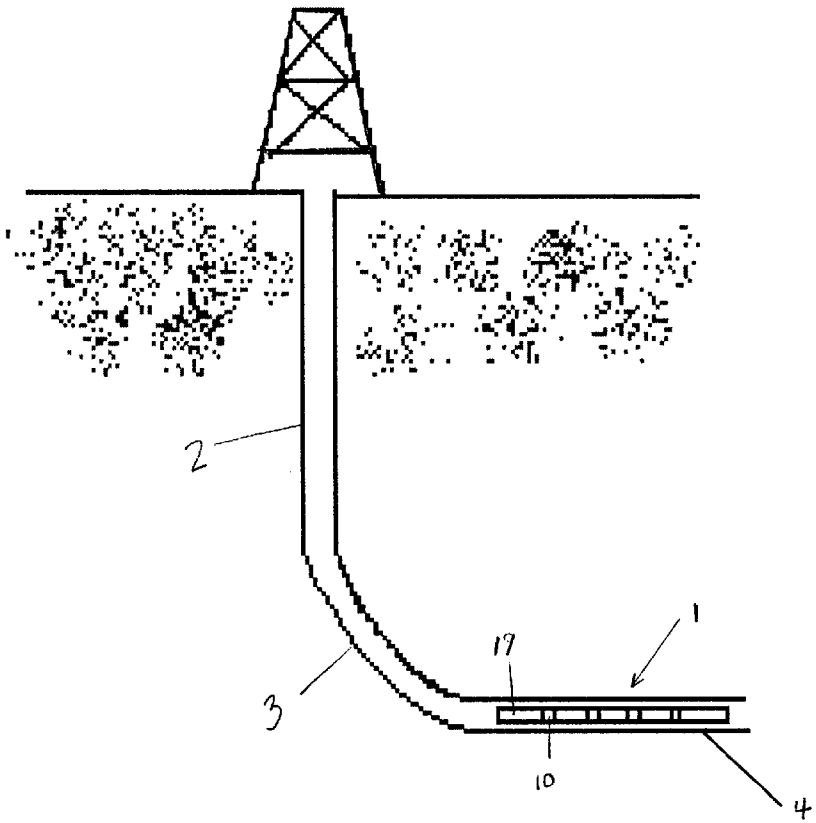
FIG. 1 illustrates a cross-sectional view of the present invention disposed within a wellbore.

With reference to the drawing herein, a flexible swiveling system according to one embodiment of the present invention is shown in FIG. 1. The perspective view of FIG. 1 illustrates a tool string 1 disposed within a wellbore 2 and having multiple perforating guns 19 connected at their ends by swiveling subs 10. However, the flexible swiveling system is not restricted to including only perforating guns, other downhole tools such as well logging devices can be used in the tool string 1 in conjunction with the swiveling subs 10.

Figure 2:
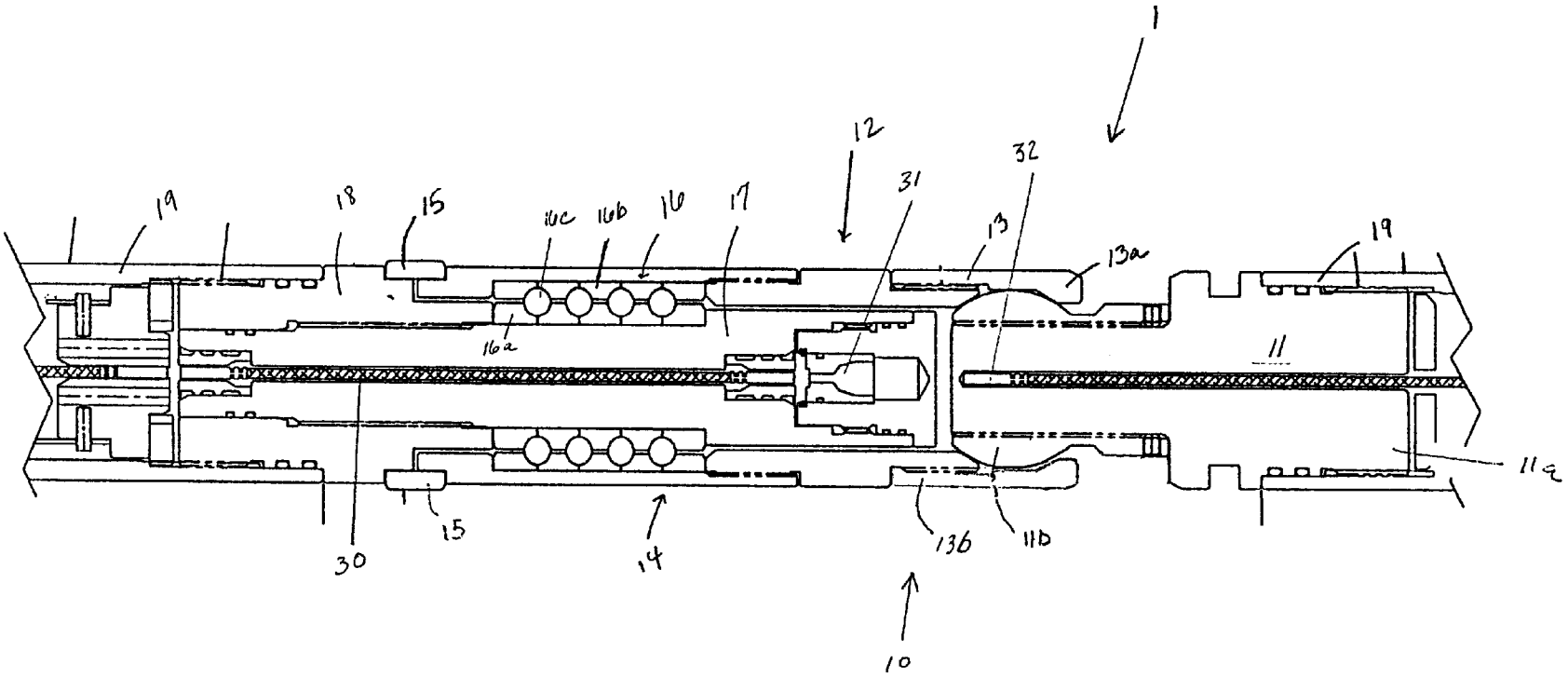
FIG. 2 depicts a cross-sectional view of the perforating system of the present invention.
Figure 3:
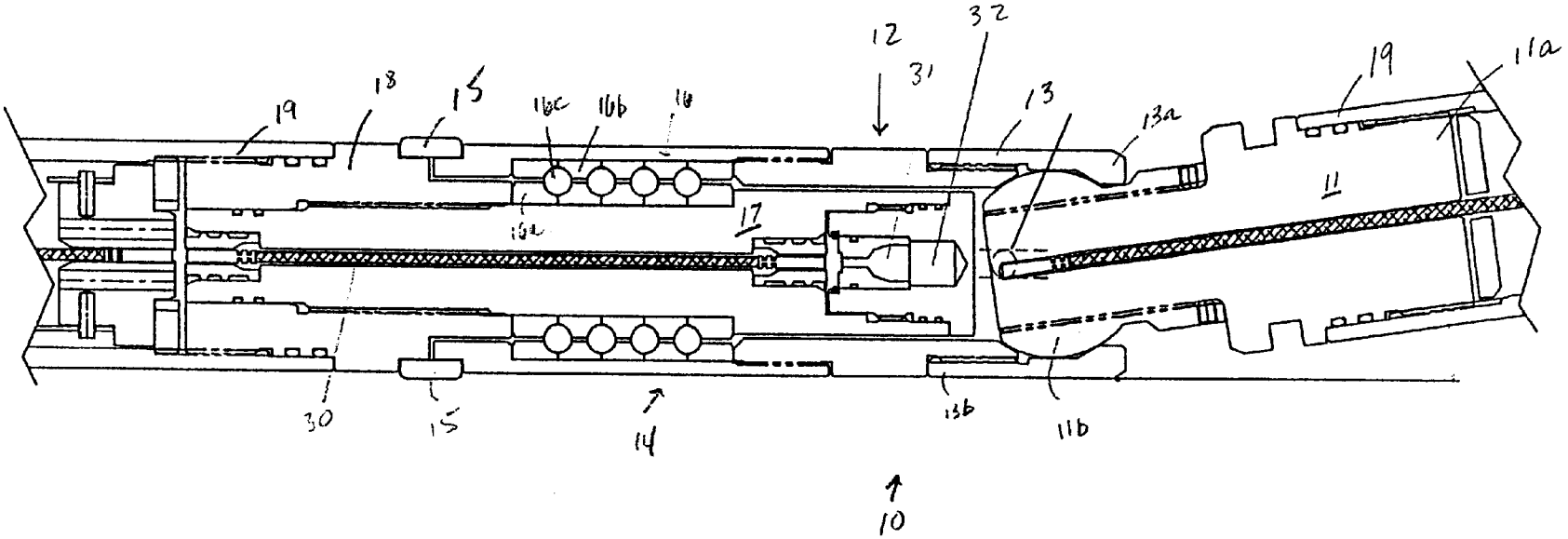
FIG. 3 portrays a cross-sectional view of the perforating system in a swiveling configuration.

FIG. 2 illustrates details of the swiveling sub 10 and its interface with the perforating guns 19. The swiveling sub 10 consists of two sections, a ball sub 11 and a socket sub 12. The ball sub 11 is threadedly connected to a perforating gun 19 on its first end 11*a* and swivellingly connected on its second end 11*b* to the socket sub 12. The socket sub 12 is comprised of a socket flange 13 threadedly connected on its second end 13*b* to the socket housing 14. The socket flange 13 is generally tubular with an outer radius that is relatively constant along its length. Conversely its inner radius decreases proximate to the socket flange 13 first end 13*a* to form an inwardly protruding lip at the first end 13*a*. The lip of the socket flange 13 first end 13*a* and the presence of the socket housing 14 prevent axial displacement of the ball sub 11 second end 11*b* outside of the socket housing 14. The rounded surface of the ball sub 11 second end 11*b* enables the ball sub 11 to rotate as well as pivot with respect to the socket flange 13. While the ball sub 11 can pivot up to 15° with respect to the socket sub 12, the preferred maximum pivot angle between the ball sub 11 and the socket sub 12 is 8°.

Disposed within the socket sub 12 is a mandrel 17 that is generally cylindrical. The mandrel 17 axially rotates within the socket sub 12 on a bearing assembly 16 that is disposed between the mandrel 17 and the socket sub 12. The bearing assembly 16 includes an inner race 16*a*, an outer race 16*b*, and a plurality of ball bearings 16*c*. As shown in the accompanying figure the ball bearings 16*c* consist of four series of bearings encircling the inner race 16*a*. It has been determined that providing more than one series of bearings distributes axial loads better than a single series of bearings. The enhanced loading on the bearings allows rotation of the mandrel 17 within the socket sub 12 even when axial forces (compressive or tensile) exceeding 20,000 pounds are present along the bearings. The mandrel 17 is attached to a perforating gun 19 on the end opposite to its connection to the socket sub 12. Attachment of the mandrel 17 to the perforating gun 19 is accomplished by the upper connector 18. A wear ring 15 is attached to the outer circumference of the tool string 1 proximate to the interface between the socket housing 14 and the upper connector 18. The material for the components of the above described device is not considered to be a part of the invention, but instead it is appreciated that a wide variety of materials are suitable which could be determined by one skilled in the art.

Located within both sections of the axial sub 10 is a detonating cord 30 that travels axially through the center of each section. As is well known in the art, the detonating cord 30 transfers an explosive detonation force along its length that is ultimately transferred to shaped charges located within the perforating gun 19. To facilitate the detonation transfer of the detonating cord 30 between the ball sub 11 and the socket sub 12, a cord shaped charge 31 in cooperation with an explosive booster 32, is positioned within the socket sub 12. As is well known, when the detonation wave along the detonating cord 30 reaches the cord shaped charge 31, detonation of the cord shaped charge 31 and explosive booster 32 occurs, which in turn propagates detonation of the detonation cord 30 from the socket sub 12 to within the ball sub 11.

The wellbore 2 typically is not straight but instead usually has multiple bends along its length. This is especially true in the deviated section 3 and the horizontal section 4 of the wellbore 2. Because the tool string 1 usually is made up of numerous perforating guns or other downhole devices, its length can range from less than 100 feet to over 3000 feet in length. When these multiple section tool strings are inserted through the bends and elbows in the wellbore 2, the tool string must also bend to conform to the wellbore 2 contour. These contortions subjected upon the tool string in turn produce tensile and compressive stresses on the tool string's individual members. If the individual members of the tool string are designed to rotate about their axes with respect to adjacent members, the applied tensile and compressive stresses can hinder or prevent that rotation.

In contrast, the components of the tool string 1 of the present invention will not experience compressive or tensile loads that can be caused by uneven contours of the wellbore 2. The pivoting action provided by the swiveling sub 10 produces a flexible tool string 1 that conforms to the wellbore 2 contours without experiencing internal compressive or tensile loading. Because the individual members of the present invention, including perforating guns, are able to pivot and bend with respect to adjacent members, free rotation of the members about their axes is easily achieved in spite of being positioned in a wellbore having bends or elbows.

Since the wear ring 15 has an outer diameter that exceeds the outer diameter of the perforating gun 19, the wear ring 15 prevents the outer surface of the perforating gun 19 from contacting the inner diameter of the wellbore 2. This reduces the damage or wear of the perforating gun 19 caused by interface with the wellbore 2 inner diameter. Further, preventing contact of the perforating gun 19 with the wellbore 2 inner diameter better enables free rotation of the perforating gun 19 about its axis.

Application of the swiveling sub 10 is not limited to connecting perforating guns 19, instead the swiveling sub 10 can be used in lieu of other connectors presently used to produce an extended string for insertion into a wellbore. This is especially helpful when individual sections of the string are long and are threadedly connected end to end. Corresponding male and female threaded connections must be coaxially aligned before initiating the mating process, which can be difficult when dealing with long individual string sections. Because the sections of the swiveling sub 10 swivel and rotate with respect to the other, coaxial alignment of their threaded connections with the string sections is relatively simple. Therefore, utilization of the swiveling sub 10 to connect long individual string sections can alleviate string section coaxial misalignment, thereby speeding up string make up.

The present invention described herein, therefore, is well adapted to carry out the objects and attain the ends and advantages mentioned, as well as others inherent therein. While a presently preferred embodiment of the invention has been given for purposes of disclosure, numerous changes in the details of procedures for accomplishing the desired results. Such as the utilization of journal or roller bearings in the bearing assembly. Additionally, the device and method described herein is suitable for use in any type of well, such as a water well, and is not restricted to use in hydrocarbon producing wells. These and other similar modifications will readily suggest themselves to those skilled in the art, and are intended to be encompassed within the spirit of the present invention disclosed herein and the scope of the appended claims.

What is claimed is:

1. A perforating system for use in a well comprising:

at least two perforating guns; and at least one swiveling sub located between two adjacent perforating guns and connecting said guns end to end;

each said at least one swiveling sub comprising two sections, each section being pivotally connected to the other section at one end and connected to one of said perforating guns on the other end.

2. The perforating system of claim 1, where the axis of each said pivotally connected section can pivot up to 8° with respect to the axis of the next adjacent pivotally connected section.

3. The perforating system of claim 1 further comprising a wear ring positioned radially around each said perforating gun having an outer diameter greater than the outer diameter of said perforating gun.

4. The perforating gun of claim 1, where said two sections are pivotally connected by a ball and socket configuration.

5. The perforating system of claim 1 further comprising a detonation cord axially disposed within each said section.

6. The perforation system of claim 5 further comprising an explosive device that passes explosive detonation from a detonation cord disposed in one section to a detonation cord disposed in an adjacent section.

7. The perforating system of claim 6 wherein the axes of said adjacent sections are pivoted up to 8° with respect to one another.

8. The perforation system of claim 1 where each said perforating gun rotates about its axis with respect to said swiveling sub.

9. The perforating system of claim 8 further comprising two or more series of bearings to facilitate axial rotation of each said perforating gun with respect to said swiveling sub.

10. The perforating system of claim 1, where the axis of each said pivotally connected section can pivot up to 15° with respect to the axis of the next adjacent pivotally connected section.

11. A downhole tool for use in deviated wells comprising:

two or more longitudinal segments connected end to end by a swiveling connector;

said swiveling connector comprising two sections pivotally connected on one end and connected to one of said longitudinal segments on the other end.

12. The downhole tool of claim 11, where the axis of each said pivotally connected section can pivot up to 8° with respect to the axis of the next adjacent pivotally connected section.

13. The downhole tool of claim 11 further comprising a wear ring positioned radially around each said longitudinal segment having an outer diameter greater than the outer diameter of said longitudinal segment.

14. The downhole tool of claim 11, where said pivotally connected sections are connected by a ball and socket configuration.

15. The downhole tool of claim 11 further comprising a detonation cord axially disposed within each said pivotally connected section.

16. The downhole tool of claim 11 further comprising an explosive device that passes explosive detonation from a detonation cord disposed in one pivotally connected section to a detonation cord disposed in the next adjacent pivotally connected section.

17. The downhole tool of claim 11 where each said longitudinal segment rotates about its axis with respect to said pivotally connected section.

18. The perforating system of claim 11 further comprising at least two series of bearings to facilitate axial rotation of said longitudinal segment with respect to said pivotally connected section.

19. A downhole tool for use in a well comprising:

at least two elongated segments; and at least one swiveling sub located between two adjacent elongated segments and connecting said elongated segments end to end;

each said at least one swiveling sub comprising two sections, each section being pivotally connected to the other section at one end and connected to one of said elongated sections on the other end.

20. The downhole tool of claim 19, where said two sections are pivotally connected by a ball and socket configuration.

* * * * *